US006164096A

United States Patent [19]

Lai

[11] Patent Number: 6,164,096

[45] Date of Patent: Dec. 26, 2000

[54] HOUSING CONSTRUCTION FOR ROTATING DIAL COMBINATION PADLOCKS

[75] Inventor: Eric Lai, Calgary, Canada

[73] Assignee: The Sun Lock Co Ltd., The Hong Kong Special Administrative Region of the People's Republic of China

[21] Appl. No.: 09/401,368

[22] Filed: Sep. 21, 1999

Related U.S. Application Data

[63] Continuation-in-part of application No. 09/122,607, Jul. 27, 1998, abandoned.

[51] Int. Cl.[7] ..... E05B 37/02; E05B 67/02

[52] U.S. Cl. ..... 70/25; 70/52; 70/56; 70/443; 70/DIG. 43; 70/DIG. 56

[58] Field of Search ..... 70/20–30, 50–52, 70/54–56, 417, 442–444, DIG. 43, DIG. 56

[56] References Cited

U.S. PATENT DOCUMENTS

| | | | |
|---|---|---|---|
| 212,892 | 3/1879 | Budd | 70/52 |
| 405,329 | 6/1889 | Smith | 70/52 |
| 445,121 | 1/1891 | Mix | 70/52 |
| 465,897 | 12/1891 | Troast et al. | 70/52 |
| 467,506 | 1/1892 | Hunter | 70/52 |
| 504,034 | 8/1893 | Hay | 70/25 |
| 816,492 | 3/1906 | Mohr | 70/52 |
| 1,157,041 | 10/1915 | Reynolds | 70/52 |
| 1,157,135 | 10/1915 | Wesson et al. | 70/52 |
| 2,550,655 | 4/1951 | Holan | 70/52 |
| 2,662,385 | 12/1953 | Zavoico | 70/52 |
| 2,744,404 | 5/1956 | Vile | 70/52 |
| 3,386,271 | 6/1968 | Morin | 70/25 |
| 3,388,572 | 6/1968 | Morin | 70/25 |
| 3,410,121 | 11/1968 | Morin | 70/25 |
| 3,720,082 | 3/1973 | Feinberg et al. | 70/25 |
| 3,835,676 | 9/1974 | Foote | 70/52 |
| 3,848,440 | 11/1974 | Manuel | 70/55 |
| 4,134,280 | 1/1979 | Pelavin | 70/55 |
| 4,444,029 | 4/1984 | Remington | 70/25 |
| 4,534,190 | 8/1985 | Stanich | 70/54 |
| 4,576,022 | 3/1986 | Gamble | 70/417 X |
| 4,651,543 | 3/1987 | Heald et al. | 70/54 |
| 4,733,548 | 3/1988 | Ling | 70/25 |
| 4,744,229 | 5/1988 | Stanich | 70/54 |
| 4,819,465 | 4/1989 | Stanich | 70/56 |
| 4,829,794 | 5/1989 | Crown | 70/25 |
| 4,882,918 | 11/1989 | Stanich | 70/54 |
| 4,970,881 | 11/1990 | Hsiao | 70/25 |
| 5,033,279 | 7/1991 | Lebrecht | 70/55 |
| 5,046,339 | 9/1991 | Krell | 70/55 |
| 5,125,248 | 6/1992 | Ling | 70/25 |
| 5,156,029 | 10/1992 | Heald | 70/55 |
| 5,236,527 | 8/1993 | Brodsky | 70/53 X |
| 5,520,032 | 5/1996 | Ling | 70/25 |
| 5,704,231 | 1/1998 | Heald | 70/55 X |
| 5,791,169 | 8/1998 | Kuo | 70/52 X |
| 5,832,752 | 11/1998 | Zeller | 70/52 X |

FOREIGN PATENT DOCUMENTS

| | | | |
|---|---|---|---|
| 494178 | 3/1930 | Germany | 70/52 |
| 528953 | 7/1931 | Germany | 70/52 |
| 811927 | 8/1951 | Germany | 70/52 |
| 615197 | 1/1949 | United Kingdom | 70/52 |

*Primary Examiner*—Lloyd A. Gall
*Attorney, Agent, or Firm*—Melvin I. Stoltz

[57] ABSTRACT

By providing a removable cover assembly mountable to a rotating dial of a central housing of a padlock, a padlock construction is attained which is visually distinctive and can be custom tailored to individual consumer choice. The cover assembly of the present invention is preferably constructed from two cooperating components, thereby providing ease of assembly and removal. In its preferred construction, the cover assembly is formed in a plurality of alternate colors, styles, designs, and the like, with or without indicia displayed thereon providing for visual distinctiveness and coordination with luggage products. Furthermore, the cover assembly is also constructed in a manner which enables the dials of the padlock to be easily accessed for use as well as incorporating a visually distinctive combination read-out zone for improved visibility.

17 Claims, 6 Drawing Sheets

HOUSING CONSTRUCTION FOR ROTATING DIAL COMBINATION PADLOCKS

RELATED APPLICATIONS

This application is a Continuation-in-Part Application of U.S. patent application Ser. No. 09/122,607, filed Jul. 27, 1998, abandoned, entitled Housing Construction for Rotating Dial Combination Padlocks.

TECHNICAL FIELD

This invention relates to combination padlocks, and, more particularly, to combination padlocks incorporating uniquely designed cover assemblies thereon.

BACKGROUND ART

Numerous padlock constructions have been developed and are widely employed by individuals to prevent unauthorized persons from gaining access to any area which has been closed and locked. Although many locks are constructed to be opened by a key, numerous combination locks have been developed which are opened by the knowledge of a particular combination.

One particular type of combination padlock that has become very popular due to its easy and convenience of use is a combination padlock which employs a plurality of rotatable, independent dials, each of which form one of the indicia, usually numerals or letters which comprise the combination for releasing the lock. Padlocks of this general nature had become very popular and are widely employed, particularly for use in connection with luggage, suitcases, carrying cases, gym bags, brief cases, and the like.

One of the difficulties or objections often encountered with these combination padlocks is the result of changing fashion and the ever-increasing desire for coordination or matching of colors, styles, and/or individual expression. Since most prior art combination locks are constructed from a single type of material, usually brass or steel, all of the prior art padlocks have a single visual appearance. As a result, the desire for coordination or matching of colors, and styles is incapable of being attained by these prior art padlocks. In addition, consumer's desire for individuality is incapable of being satisfied, when every padlock has a substantially identical appearance.

Another objection often encountered with these prior art combination padlocks is the difficulty typically encountered in visually identifying the alignment zone for the designated combination which must be displayed to enable the lock to be opened. In addition, although most rotating dial combination padlocks have the alignment zone along the vertical edge of the padlock, some constructions incorporate an alignment zone along one of the side walls. In addition, once a particular zone has been identified, consumers find it difficult to visually identify the particular numeral or letter on the dial which falls in the desired zone.

In an attempt to resolve this drawback, some prior art combination locks have constructed the padlock casing with the vertically aligned readout windows formed along the edge of the padlock in order to provide a visually distinctive alignment zone for the combination. However, these prior art padlocks are specifically limited to particular padlocks incorporating a casing having this construction. As a result, consumers are required to purchase a new padlock with this specific construction, instead of enabling virtually any rotating dial combination padlock to be reconfigured in a quick and easy manner to provide this desirable visual display.

Therefore, it is a principal object of the present invention to provide a rotating dial combination padlock construction which incorporates inexpensively produced panel members for peripherally surrounding and enclosing the padlock to provide a variety of different visually distinctive appearances.

Another object to the present invention is to provide a rotating dial combination padlock construction having the characteristic features described above wherein padlocks are easily produced in a wide variety of different styles, colors, patterns, designs, and the like for coordinating with any desired product with which the padlock is associated or enabling individuals to express this individuality.

Another object in the present mention is to provide a rotating dial combination padlock construction having the characteristic features described above wherein vertically aligned readout windows are easily achieved on the housing of a conventional padlock defining the combination alignment zone.

Another object of the present invention is to provide a rotating dial combination padlock construction having the characteristic features described above wherein a single padlock is able to be easily converted between a plurality of alternate designs, colors, styles, patterns, and the like.

Other and more specific objects will in part be obvious and will in part appear hereinafter.

SUMMARY OF THE INVENTION

By employing the present invention, all of the difficulties and drawbacks of the prior art constructions are virtually eliminated and an effective, easily produced, rotating dial combination padlock is achieved which is capable of being easily coordinated with any desired product, regardless of the visual appearance of the product. In addition, by employing the present invention, an easily observed, readily seen, visually distinctive readout window alignment zone is imparted to an otherwise conventional padlock.

In order to attain these desirable and heretofore unattainable results, the present invention provides a cover assembly mountable to the central housing of a rotating dial padlock in a manner which enables the dials of the padlock to be easily accessed for use. In the preferred embodiment, the cover assembly incorporates a construction which provides a vertically aligned readout window zone for enabling the combination display area to be readily identifiable and easily distinguished from the surrounding area. In this way, an otherwise conventional rotating dial combination padlock is easily and quickly converted into a visually distinctive product, having a readily identifiable and easily used alignment zone, without requiring the lock to be replaced by a totally different padlock or requiring the alignment zone to be displayed in its conventional manner.

An additional feature preferably provided by the cover assembly of the present invention is the incorporation of a plurality of alternate colors, styles, designs, and the like, all of which are constructed for matching or coordinating with the conventional colors, styles, designs, etc., commonly employed on luggage items, such as suitcases, briefcases, gym bags, etc. In this way, by employing the present invention, a rotating dial combination padlock is achieved which is capable of matching or coordinating with the precise appearance of the product upon which the padlock is employed. As a result, the combination padlock of the present invention incorporates identical or complementary colors, styles, designs, patterns, and the like, which precisely match or coordinate with the product upon which the padlock is mounted. In this way, the increasing desire for visual distinctiveness or coordinated products is attained.

In achieving the present invention, the cover assembly taught herein is preferably constructed from two cooperating components or cover-forming members, thereby providing ease of assembly, removal, as well as complete peripheral surrounding envelopment of the central housing of the padlock. Depending upon the type of construction desired, these two cooperating components may be permanently mounted on the central housing of the padlock or constructed for being removably mounted on the central housing.

By permanently mounting the cooperating components forming the cover assembly of the present invention to the central housing of the padlock, a final, fully assembled, aesthetically pleasing and easily employed padlock construction is realized. In particular, if one particular color, style, or surface treatment is desired by the user, the permanent affixation of the cover assembly to the central housing would be desirable.

Alternatively, for those consumers who prefer to employ a padlock with a variety of alternate products, each of which has a different color, style, design, and the like, the alternate embodiment of this invention would be employed. In this alternate construction, the components forming the cover assembly are removably mounted to the central housing of the padlock. As a result, the consumer is able to easily change the visual appearance of the padlock by merely removing one cover assembly and substituting therefor a cover assembly housing or desired color, style, design, etc. for matching or coordinating with the product on which the padlock is being used.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings in which.

DETAILED DESCRIPTION

By referring to FIGS. 1–7, along with the following detailed disclosure, the construction and operation of the decorative, visually distinctive padlock cover assembly of the present invention can best be understood. Although two alternate embodiments of the present invention are depicted in the Figures and detailed herein, further alternate constructions can made without departing from the scope of this invention. Consequently, it is to be understood that the following detailed disclosure is intended to provide examples of the present invention and is not intended as limiting the present invention to the specific embodiments detailed herein.

Figure 1:
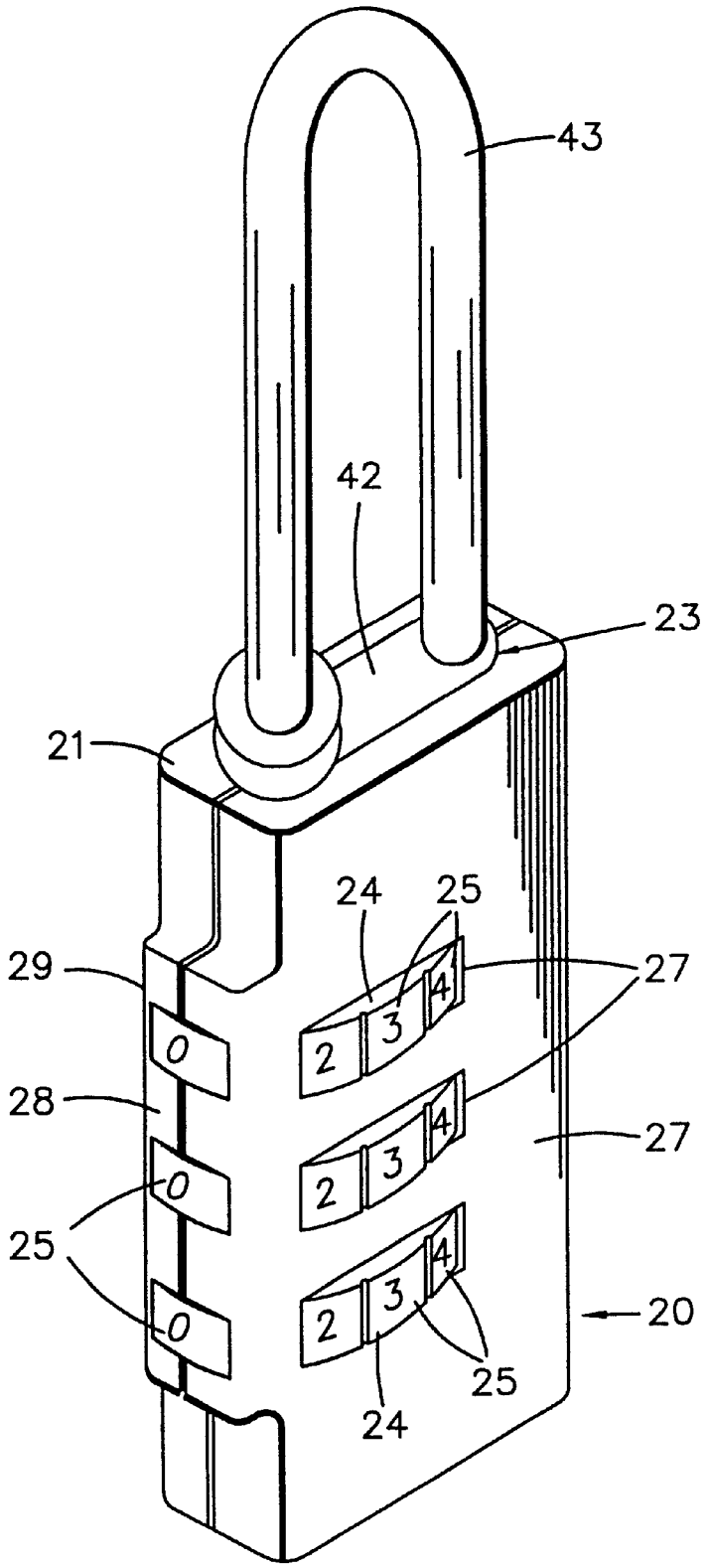
FIG. 1 is a perspective view of the padlock cover assembly of the present invention securely mounted to the central housing of a padlock.
Figure 2:
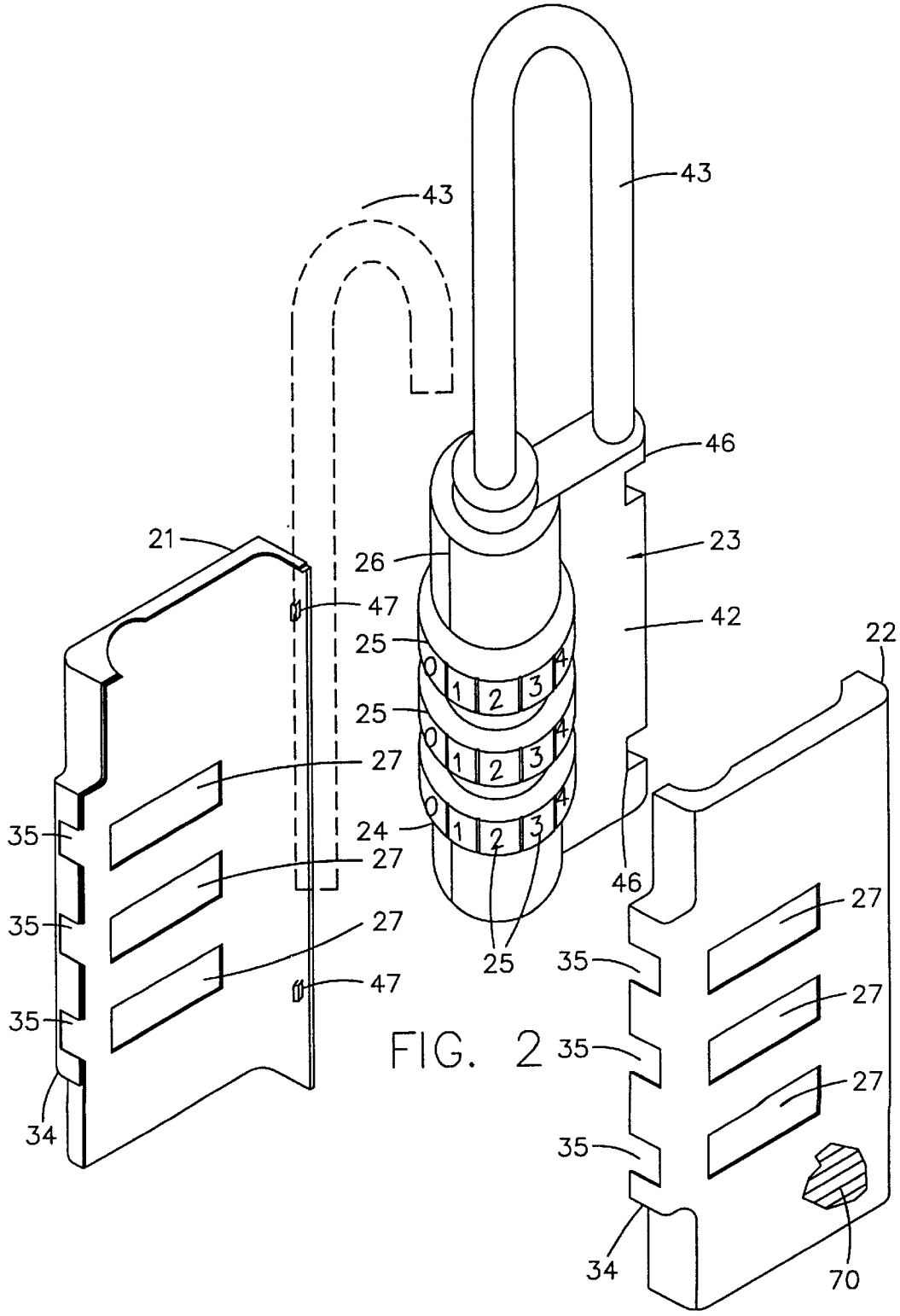
FIG. 2 is an exploded perspective view of the padlock cover assembly and padlock of FIG. 1.
Figure 4:
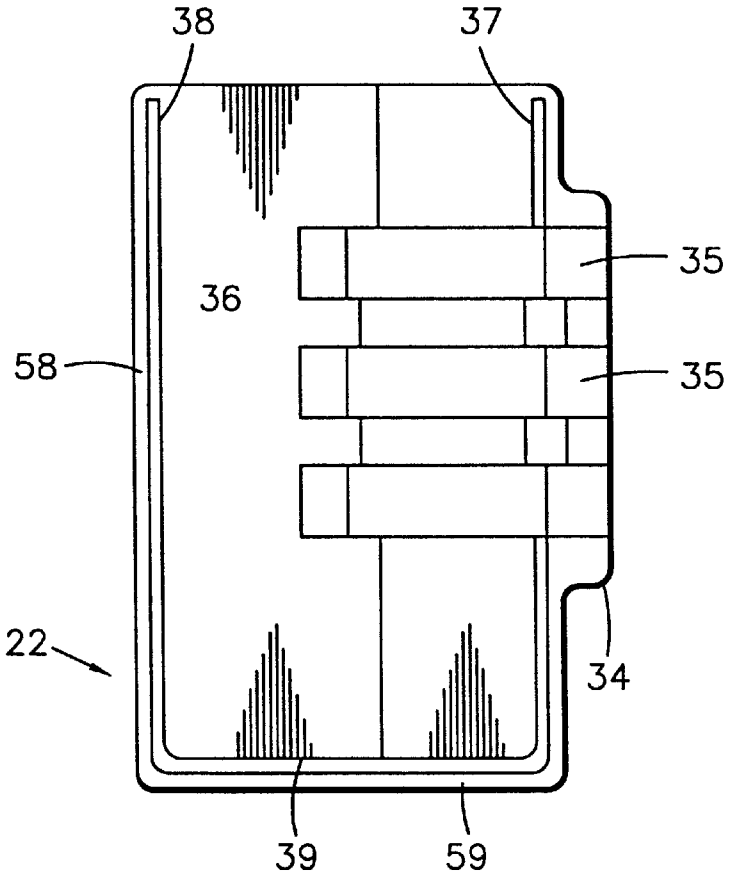
FIG. 4 is a side elevation view depicting the interior surface of the second cover member forming the padlock cover assembly of this invention.
Figure 3:
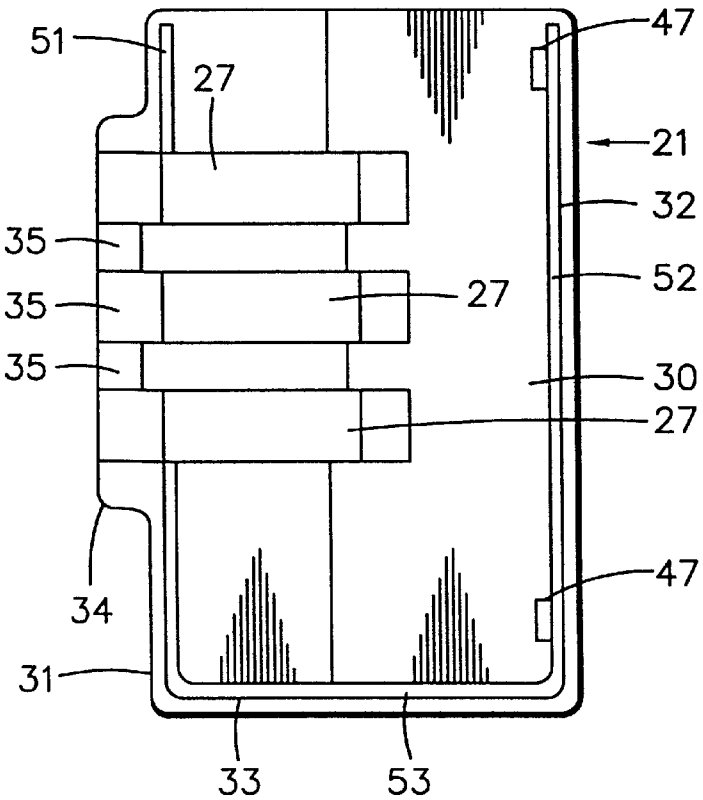
FIG. 3 is a side elevation view depicting the interior surface of one cover member forming the padlock cover assembly of this invention.
Figure 5:
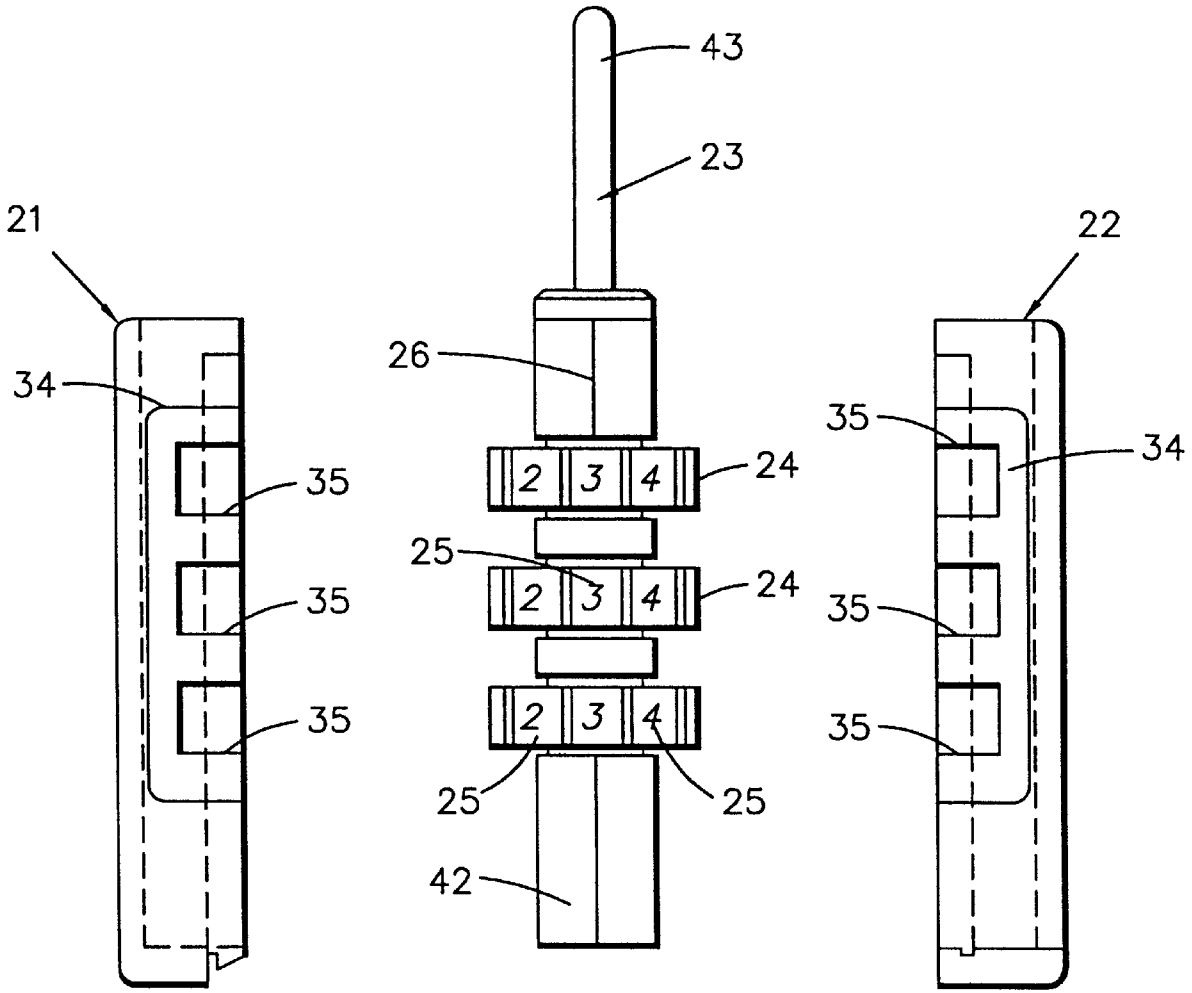
FIG. 5 is a front elevation view of the two cover members forming the padlock cover assembly of this invention in juxtaposed, spaced, cooperating relationship with each other.
Figure 6:
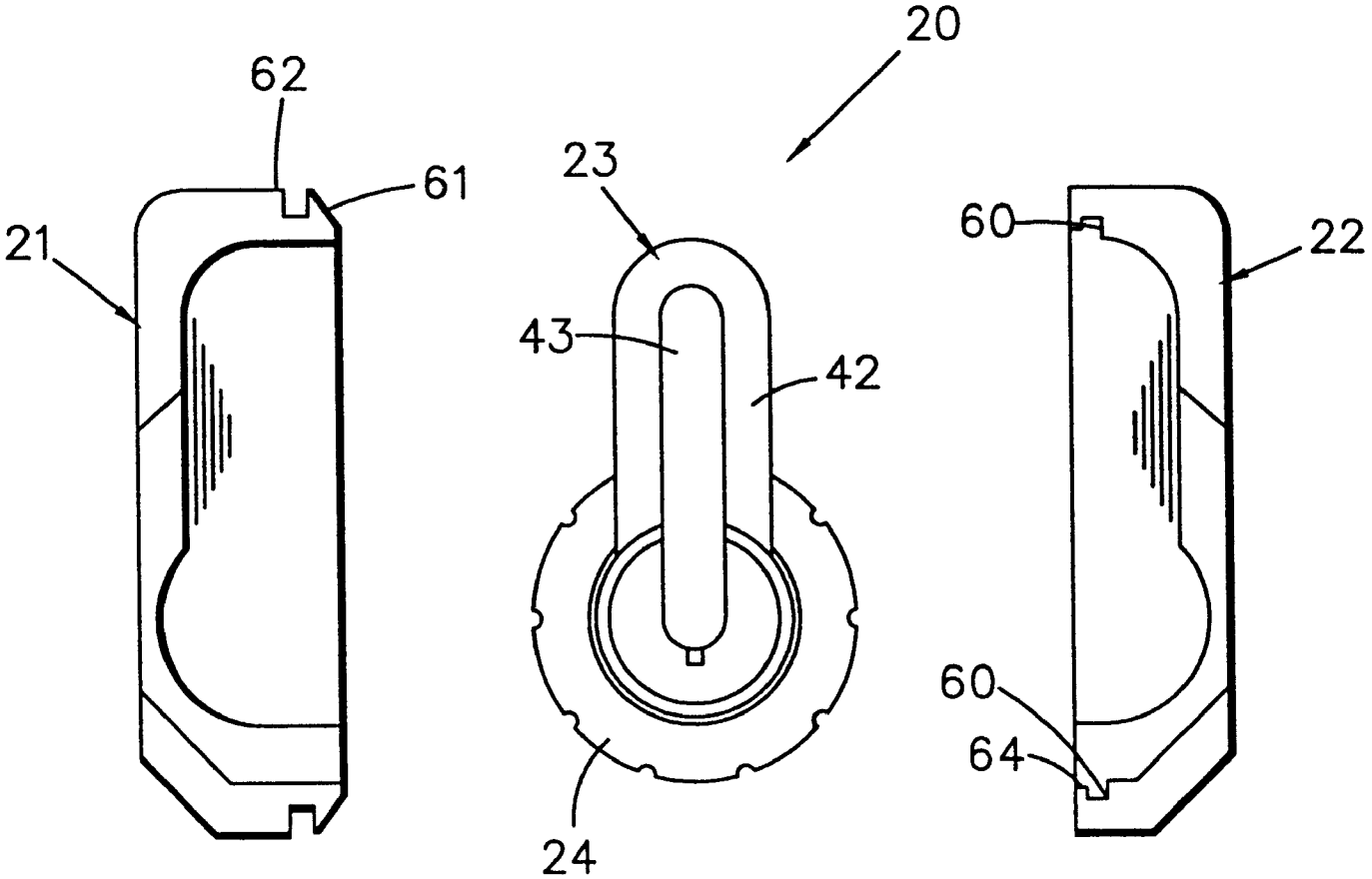
FIG. 6 is a top plan view of the two cover members forming the padlock cover assembly of this invention in juxtaposed, spaced, cooperating relationship with each other.

As best seen in FIGS. 1 and 2, decorative, visually distinctive padlock cover assembly 20 of the present invention comprises cooperating decorative and/or visually distinctive cover members 21 and 22. Cover members 21 and 22 are constructed for peripherally surrounding and substantially enveloping a fully assembled and operational padlock 23.

In accordance with the present invention, padlock 23 comprises a fully assembled, combination or rotating dial padlock 23, which comprises a central housing 42, latching or locking means depicted in the form of shackle 43, and rotating dials 24. In the preferred embodiment, central housing 42 incorporates therein all of the operating mechanisms required for enabling padlock 23 to function in the desired manner. In general, padlock 23 comprises a construction as disclosed in my U.S. Pat. No. 5,715,709, the pertinent disclosure of which is hereby referred to and incorporated herein by reference.

As depicted, padlock 23 comprises three separate and independent rotatable dials 24, each of which are preferably mounted to central housing 42, with each dial incorporating a plurality of indicia 25, preferably in the form of the numerals, formed on the outer peripheral surface thereof. In the typical construction, one indicia 25 of each dial 24 represents one component of the combination for enabling padlock 23 to be unlocked or opened when desired by the user. Furthermore, in order to assist the user in properly aligning the correct combination, visual indicator or alignment line 26 is preferably formed on the outer surface of central housing 42.

In the embodiment depicted, once the user has placed indicia 25 of rotatable dials 24 in the proper orientation for displaying the preset combination, shackle 43 is released and is capable of axial movement out of locked engagement in central housing 42. In the preferred construction, shackle 43 comprises a j-shape, with the shorter leg thereof being lockingly engaged with central housing 42 and, once released, capable of movement out of housing 42 and arcuate pivoting movement about the axis defined by the longer leg. In this way, any desired product can be secured and locked by shackle 43 whenever desired by the user.

In accordance with the present invention, and as is evident from the foregoing detailed discussion, padlock 23 comprises a generally conventional construction, having any desired size, shape, and/or configuration. As fully detailed herein, the present invention resides in providing a decorative, visually distinctive padlock cover assembly 20, which peripherally surrounds and substantially envelopes padlock 23, imparting thereto any desired unique, changeable, decorative, and/or visually distinctive appearance.

In carrying out the teaching of the present invention, it is evident that fully assembled padlock 23 comprises a central housing 42 which is formed from one or more cooperating components. If desired, two panels may be fastened together in order to form central housing 42. However, a construction of this nature merely comprises a conventional, well-known, prior art padlock-forming housing, which does not contemplate, teach or suggest the unique, decorative, and/or visually distinctive cover assembly 20 of the present invention.

As clearly shown in FIGS. 1 and 2, cover members 21 and 22 of padlock cover assembly 20 peripherally surround and fully envelope the sides of central housing 42 of padlock 23, while cooperating with rotatable dials 24 thereof. In order to enable rotatable dials 24 of padlock 23 to freely operate as intended, cover members 21 and 22 each incorporate elongated slots 27 formed in the side surface thereof. Each elongated slot 27 is constructed for surrounding a rotatable dial 24, while enabling each dial 24 to be freely rotatably movable as desired by the user.

In addition, in the preferred embodiment, decorative, visually distinctive padlock cover assembly 20 incorporates an elongated raised ledge 28 formed on the front edge of padlock cover assembly 20. In addition, a plurality of separate and independent cut-out zones or windows 29 are formed in raised ledge 28, positioned in cooperating relationship with elongated slots 27.

By employing this embodiment of the present invention, elongated raised ledge 28 is positioned in overlying relationship with alignment line 26 of central housing 42, thereby establishing and defining a highly visible, readily seen display zone for the indicia defined combination which allows padlock 23 to be opened. In this way, the correct indicia 25 are prominently displayed, with cutout zones or windows 29 providing focus means for displaying indicia 25 formed on rotating dials 24, enabling the indicia to be easily seen in a vertically aligned relationship. In this way, all individuals, particularly individuals with vision impairment, are able to see the precise indicia displayed in windows 29, thereby enabling the correct combination to be easily and quickly set for opening padlock 23.

By referring to FIGS. 3–6, along with the following detailed discussion, the construction and operation of the preferred embodiment of padlock cover assembly 20 of the present invention can best be understood. Cover member 21 comprises a substantially flat panel member 30 which is peripherally surrounded on three sides thereof by upstanding, edge-forming wall members 31, 32, and 33. In this construction, wall member 31 forms the front edge of cover member 21, while wall member 32 forms the rear edge and wall member 33 forms the bottom edge thereof.

As discussed above, panel member 30 incorporates a plurality of slots 27 formed therein, each of which are constructed for mating, peripheral surrounding engagement with rotatable dials 24 of central housing 42 of padlock 23. In addition, each slot 27 is constructed for assuring that rotatable dials 24 are retained therein for being easily moved whenever desired by the user.

In addition, cover member 21 also incorporates a raised, surface 34 formed on front edge-forming wall member 31. Furthermore, open, cut-out zones 35 are formed in raised surface 34, each of which are aligned with one elongated slot 27. As is more fully detailed below, raised surface 34 and open, cut-out zones 35 cooperate with similar elements formed on cover member 22 for producing elongated raised ledge 28 and windows 29.

Similarly, cover member 22 comprises a substantially flat panel member 36 which is peripherally surrounded by upstanding, edge forming wall members 37, 38, and 39. In the construction depicted, wall member 37 forms the front edge of cover member 22, while wall member 38 forms the rear edge thereof and wall member 39 forms the bottom edge thereof. In addition, panel member 36 incorporates a plurality of elongated slots 27, each of which are constructed for cooperating with a rotatable dial 24 of central housing 42 of padlock 23. As discussed above, slots 27 are formed for peripherally surrounding dials 24, while enabling dials 24 to be freely rotatable whenever desired by the user.

Cover member 22 also incorporates raised surface 34 formed on front edge-forming wall member 37, with a plurality of cut-out zones 35 formed in raised surface 34. As previously stated, cut-out zones 35 cooperate with cut-out zones 35 of cover member 21, when fully assembled to form windows 29. In addition, raised surface 34 of cover member 22 cooperates with raised surface 34 of cover member 21 to form ledge 28.

In order to assure that cover members 21 and 22 are positioned peripherally surrounding central housing 42 of padlock 23 in the precisely desired location, central housing 42 incorporates notches 46 formed in the rear edge thereof as shown in FIG. 2. Furthermore, cover member 21 incorporates flanges 47 (FIGS. 2 and 3) formed along the inside surface of rear edge-forming wall member 32, with flanges 47 being positioned for mating, interengagement with notches 46 of central housing 42 of padlock 23. By employing this construction, the precisely desired alignment and positioning of cover member 21 relative to central housing 42 is assured.

If desired, cover member 22 may also incorporate a similar flange construction for mating engagement in notches 46 of padlock 23. However, for the reasons detailed below, the use of flanges 47 as part of cover member 22 is not required.

In order to provide the desired, easy assembly, engagement and disengagement of cover members 21 and 22 over central housing 42 of padlock 23, as well as provide precise co-operative aligned interengagement of cover members 21 and 22, each cover member incorporates a lip extension formed on the terminating edge of each wall member. As best seen in FIGS. 3–6, wall member 31 incorporates lip extension 51 formed at its terminating edge, while wall member 32 incorporates lip extension 52, and wall member 33 incorporates lip extension 53, both formed in a similar manner. As is evident from these figures, lip extensions 51, 52, and 53 extend co-extensively with the inside edge of each of the wall members with which each extension is associated, providing a recessed wall component peripherally surrounding three sides of panel member 30.

Similarly, lip extension 57 is formed on the terminating edge of wall member 37 of cover member 22, with lip extension 58 formed on the terminating edge of wall member 38 and lip extension 59 formed on the terminating edge of wall member 39. In addition, each lip extension 57, 58, and 59 are formed as extensions on the outside of the surface of each wall member, thereby providing a peripheral upstanding edge member substantially co-extensive with the outside surface of each respective wall member to which the lip extensions are mounted.

By employing this construction, lip extensions 51, 52, and 53 cooperate with lip extensions 57, 58, and 59 to provide an overlapping, interlocking, juxtaposed relationship with each other. When cover members 21 and 22 are mounted in interengagement with each other, the terminating edges of lip extensions 51, 52, and 53 are brought into contact with the free surface of wall members 37, 38, and 39, while the terminating edges of lip extensions 57, 58 and 59 are brought into contact with the free edges of wall members 31, 32, and 33. In this way, secure, aligned, cooperating, engaged relationship of cover members 21 and 22 is attained.

By incorporating the lip extensions detailed above, position alignment and holding of cover members 21 and 22 are attained. Consequently, the use of flanges 47 on both cover members 21 and 22 for positioning in notches 46 of padlock 23 is not required.

In the embodiment of the present invention, which is depicted in FIGS. 1–6, padlock cover assembly 20 is constructed for being removably mountable to padlock 23. In order to enable cover members 21 and 22, which form padlock cover assembly 20, to be securely engageable and disengageable with padlock 23, cover members 21 and 22 incorporate lock means which provide the desired reversible, secure, engagement of cover assembly 20 with padlock 23.

In this embodiment, the locked interengagement of cover members 21 and 22 with each other is attained by forming a locking tab receiving recess 60 in lip extensions 57, 58, and 59 of cover member 22 forward of the terminating edge, thereby also forming locking post 64 between recess 60 and the terminating edge of each lip extension. In addition, a ramped locking tab 61 is formed as the leading edge of lip extensions 51, 52 and 53, with a post-receiving recess or notch 62 formed directly adjacent to ramped tab 61.

By employing this construction, when cover members 21 and 22 are placed in alignment with each other peripherally surrounding padlock 23, lip extensions 51, 52, and 53 are aligned for cooperating with lip extensions 57, 58, and 59. As interengaging advancement of cover members 21 and 22 is made, ramped locking tab 61 overrides the leading edge of locking post 64, causing locking tab 61 to flex. This flexing continues until tab 61 reaches recess 60, at which time locking tab 61 snaps into locked interengagement with recess 60 and in abutting contact with locking post 64. At this time, locking post 64 is brought into locked engagement within recess 62, thereby providing further secure interengagement of cover member 21 with cover member 22.

If desired, locking tab receiving recess 60, ramped locking tab 61, recess 62 and post 64 may be formed as continuous elements along lip extensions 51, 52, 53, 57, 58, and 59. Alternatively, these components can be formed in a plurality of separate zones along each lip extension, with each component being positioned for cooperative, aligned, interengagement with each other.

Regardless of which construction is employed, cover members 21 and 22 are able to be placed in locked engagement peripherally surrounding and enveloping central housing 42 of padlock 23 providing the desired visual appearance to the padlock, as detailed below. In addition, whenever desired, cover members 21 and 22 are easily disengaged, removed from central housing 42 of padlock 23, and replaced by other cover members having the desired visual appearance.

If desired, other locking means can be employed without departing from the scope of the present invention. Such lock means include incorporating a plurality of raised bosses or protrusions on one surface of the lip extensions of one cover member while incorporating boss-receiving recesses on the cooperating surface of the lip extensions of the other cover member. In this way, a secure, easily attained locking system is realized which enables cover members 21 and 22 to be easily lockingly engaged with each other about the central housing of a padlock while also being easily removed from locked engagement, whenever desired by the consumer.

Another locking system that may be employed in the present invention is the incorporation of elongated finger or flange members formed on the wall members of one cover member with finger or flange receiving cavities formed on the opposed cover member. In this way, secure locked interengagement of cover members 21 and 22 is easily attained by merely inserting the protruding fingers or flanges into the receiving cavities, wherein they are placed in locked interengagement. Similarly, whenever disengagement is desired, the cover members are separated, removing the locking fingers or flanges from the associated cavities. Furthermore, in this embodiment, if desired, the lip extensions detailed above may be eliminated, since the locking fingers or flanges will provide the desired alignment and positioning of cover members 21 and 22 relative to each other.

Regardless of the locking means employed in padlock cover assembly 20 of the present invention, the resulting construction provides a padlock cover assembly which is quickly and easily mounted to the central housing of a padlock and securely retained thereon, while being removable therefrom whenever desired by the consumer. As discussed above, in each of these embodiments of the present invention, padlock cover assembly 20 is formed with a particular indicia appearing on the outside surfaces thereof. Such surface indicia or treatments include colors, designs, logos, etc., all of which produce a padlock cover assembly having a unique visual appearance. In this way, a cover assembly can be selected for matching or coordinating with the product upon which the padlock and cover assembly is mounted.

By employing the present invention, consumers are able to have a padlock which matches, coordinates with, or complements the color, style, fabric, or other visual appearance of the product upon which the padlock is secured. In addition, by constructing padlock cover assembly 20 in the manner detailed above, wherein cover members 21 and 22 are easily mountable to the central housing of the padlock, as well as easily removed therefrom, a padlock member is capable of being completely altered in its visual appearance by merely changing from one cover assembly 20 to another cover assembly 20 having the desired surface treatment. As result, consumers are capable of attaining a wide variety of styles and visual appearances for their padlocks, enabling their personal preferences, styles, and dramatic flair to be enhanced and expressed.

In FIG. 2, zone 70 represents the surface indicia or treatment employed on cover members 21 and 22. By selecting from any desired color, style, logo, surface treatment, design, and the like, a wide variety of visually distinctive cover members 21 and 22 are realized which are able to match, coordinate, or complement virtually any type of luggage, suitcase, or other product upon which padlock 23 is employed. As a result, a consumer is able to attain any precisely desired visual effect for padlock 23 by employing one of the specially constructed padlock cover assemblies 20 of the present invention.

Figure 7:
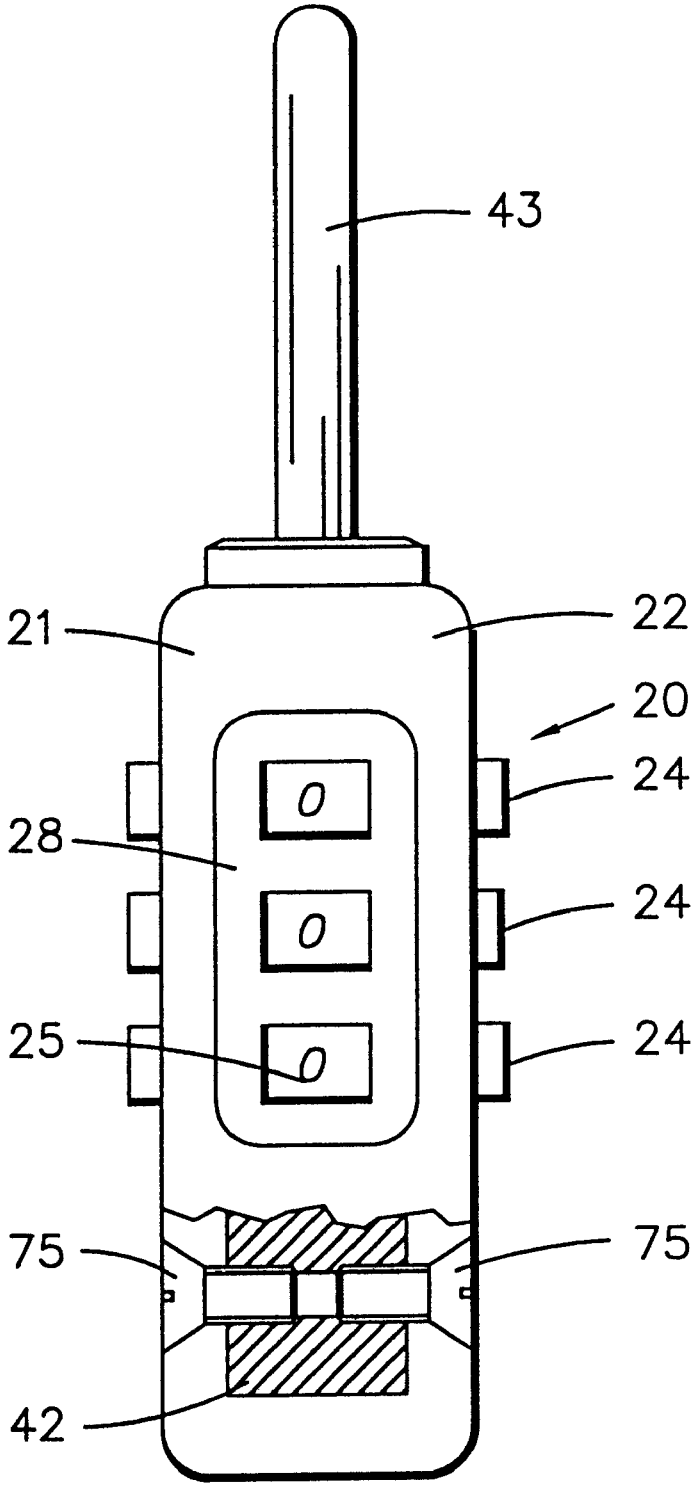
FIG. 7 is a rear elevation view of an alternate embodiment of the padlock cover assembly of the present invention securely mounted to the central housing of a padlock.

In FIG. 7, an alternate embodiment of padlock cover assembly 20 is depicted. In this embodiment, padlock cover assembly 20 comprises cover members 21 and 22 which are mounted to padlock 23 peripherally surrounding and substantially enveloping central housing 42 of padlock 23, as detailed above. In addition, cover members 21 and 22 are constructed in a manner substantially identical to the construction detailed above and shown in FIGS. 1–6.

In this regard, this embodiment of padlock cover assembly 20 also comprises, in the preferred embodiment, elongated slots formed on the side surfaces thereof for surrounding dials 24 of central housing 42 of padlock 23 while also incorporating elongated raised ledge 28 and windows 29 for enabling indicia 25 of rotatable dials 24 to be easily viewed in the zone defining the combination alignment zone.

In the embodiment depicted in FIG. 7, the principal difference incorporated therein is the secure attachment of cover members 21 and 22 to central housing 42 of padlock 23. Although a plurality of securement means can be employed for permanently retaining cover members 21 and 22 on central housing 42 of padlock 23, one affixation method is depicted in FIG. 7. In this embodiment, cover members 21 and 22 are securely retained and affixed to central housing 42 of padlock 23 by employing screw means 75. Although it has been found that a single screw 75 is able to securely retain cover member 21 to one side of central housing 42, while a second screw member 75 securely affixes cover member 22 to the opposed side of central housing 42, a plurality of screw means can be employed if desired.

It is apparent from the foregoing detailed disclosure, alternate securement methods may be employed without departing from the scope of this invention. One such alternate method is the use of sonic welding for securely mounting cover members 21 and 22 to each other in peripheral surrounding engagement with padlock 23. However, any other fastening means may be used with equal efficacy.

In the foregoing detailed disclosure, raised ledge 28 has been depicted and discussed as being located on the front edge surface of padlock cover assembly 20, since this position is typically employed in many padlocks for the combination display zone. However, in some padlock constructions, the combination display zone is located on one of the side surfaces of the central housing of the padlock. In order to accommodate a padlock having this construction, elongated, raised, ledge 28 and windows 29 are formed on the appropriate cover member in the appropriate position in order to provide the consumer with a readily identifiable, visual display area in which the opening combination for the padlock is prominently displayed. In this way, all padlock constructions are accommodated and padlock cover assembly 20 of the present invention can be employed therewith, imparting the desired visual appearance to the padlock as desired by the consumer.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to seek by Letters Patents is:

1. A decorative, visually distinctive padlock cover assembly for mounting and securely locking a desired product, said padlock cover assembly comprising:

A. a fully assembled, functional padlock member incorporating a. a central housing, b. a shackle movably mounted to the central housing for enabling the padlock to be lockingly engaged and disengaged with a desired product, and c. a plurality of dials rotatably mounted to the central housing for use in controlling the engagement and disengagement of the shackle with the padlock; and B. cover means a. constructed for peripherally surrounding and substantially enveloping the central housing, b. incorporating a plurality of elongated apertures positioned for cooperative association with the rotating dials of the central housing for enabling the dials to be arcuately moved whenever desired, and c. comprising an outer surface incorporating indicia thereon for imparting a desired visual appearance to the padlock cover assembly, whereby padlock cover assemblies having a wide variety of visual appearances are easily attained for satisfying individual tastes and desires.

2. The decorative, visually distinctive padlock cover assembly defined in claim 1 wherein said indicia is further defined as comprising one or more selected from the group consisting of color, surface contouring, designs, logos, and lettering.

3. The decorative, visually distinctive padlock cover assembly defined in claim 1, wherein said cover means is further defined as comprising two separate and independent cover members cooperatively associated with each other for peripherally surrounding and enveloping the central housing substantially in its entirety.

4. The decorative, visually distinctive padlock cover assembly defined in claim 3, wherein said cover members are fixedly mounted to each other in peripheral surrounding engagement about the central housing.

5. The decorative, visually distinctive padlock cover assembly defined in claim 4, wherein said cover members are further defined as being fixedly mounted to each other by one method selected from the group consisting of sonic welding and fastening means.

6. The decorative, visually distinctive padlock cover assembly defined in claim 3, wherein said cover members are further defined as being removably mountable to each other in peripheral surrounding engagement about the central housing.

7. The decorative, visually distinctive padlock cover assembly defined in claim 6, wherein said cover members incorporate locking means for enabling the cover members to be securely affixed to the central housing while also being quickly and easily disengaged for removal therefrom.

8. The decorative, visually distinctive padlock cover assembly defined in claim 7, wherein said locking means is further defined as comprising one selected from the group consisting of flanges and flange receiving cavities, locking tabs and tab receiving recesses, and locking fingers and finger receiving recesses.

9. The decorative, visually distinctive padlock cover assembly defined in claim 7, wherein said locking means is further defined as comprising flanges formed on one cover member and cooperating flange receiving cavities formed on the other cover member.

10. The decorative, visually distinctive padlock cover assembly defined in claim 3, wherein said cover members each comprise cooperating flange means formed along a terminating edge of each cover member with said flange means being constructed for overlapping interengagement with each other to provide secure, interlocking mounted engagement about the central housing.

11. The decorative, visually distinctive padlock cover assembly defined in claim 10, wherein at least one of said cover members incorporates flange means positioned for engagement with at least one cooperating notch formed in the central housing for assuring precise positioning of the cover member relative to the central housing.

12. The decorative, visually distinctive padlock cover assembly defined in claim 3, wherein each of said cover members is further defined as comprising an elongated raised surface formed on a front edge thereof, with said raised surface incorporating a plurality of cut-out zones, each of which are positioned for alignment with a portion of one rotating dial of the central housing, whereby said cut-out zones of each cover member cooperate to form a highly visible, readily distinguishable display zone for enabling indicia formed on the rotating dials to be prominently displayed.

13. The decorative, visually distinctive padlock cover assembly defined in claim 12, wherein each cut-out zone of one cover member is positioned for alignment with a cut-out zone of the other cover member in order to establish a display zone for one indicia of the rotating dial of the central housing.

14. The decorative, visually distinctive padlock cover assembly defined in claim 1, wherein said cover means is further defined as comprising an elongated, raised portion formed thereon incorporating apertures formed therein, positioned for cooperative alignment with the rotating dials of the central housing, thereby establishing an indicia display zone for enabling selected indicia of the rotating dials to be readily identified.

15. The decorative, visually distinctive padlock cover assembly defined in claim 14, wherein said elongated raised portion is formed on a front edge of the cover means.

16. A padlock assembly comprising a fully assembled, functional padlock including a central housing incorporating, a shackle movably mounted to the central housing for locking engagement therein and unlocked disengagement therefrom and a plurality of indicia bearing-dials rotatably mounted to the central housing for providing a locking/unlocking combination therefor, the improvement comprising cover means A. constructed for peripherally surrounding and substantially enveloping the central housing;

B. incorporating a plurality of elongated apertures positioned for cooperative association with the rotating dials of the central housing for enabling the dials to be arcuately moved whenever desired; and C. comprising an outer surface incorporating indicia thereon for imparting a desired visual appearance to the padlock assembly;

whereby padlock assemblies having a wide variety of visual appearances are easily attained for satisfying individual tastes and desires.

17. The padlock assembly defined in claim 16, wherein said shackle comprises a J-shape.

* * * * *